United States Patent [19]

Skrobisch

[11] 4,117,478

[45] Sep. 26, 1978

[54] VARIABLE CHARACTER DISPLAY DEVICE

[75] Inventor: Alfred Skrobisch, Huntington Station, N.Y.

[73] Assignee: The Staver Company, Incorporated, Bay Shore, N.Y.

[21] Appl. No.: 731,843

[22] Filed: Oct. 12, 1976

[51] Int. Cl.[2] ..... G08B 5/26

[52] U.S. Cl. ..... 340/378 R; 340/373; 340/381; 340/336

[58] Field of Search ..... 340/336 R, 373, 378, 340/381

[56] References Cited

U.S. PATENT DOCUMENTS

| | | | |
|---|---|---|---|
| 3,273,270 | 9/1966 | Skrobisch | 340/336 |
| 3,678,426 | 7/1972 | Pihl | 340/373 X |
| 3,886,545 | 5/1975 | Skrobisch | 340/378 R |
| 4,024,532 | 5/1977 | Sherwin | 340/336 |

*Primary Examiner*—Harold I. Pitts
*Attorney, Agent, or Firm*—Edward H. Loveman

[57] ABSTRACT

A variable character display device includes a base plate on which is a multiplicity of variable segment display mechanisms. Each mechanism comprises a substantially flat display segment carried by a rotatable arm. A magnet secured to the arm is magnetically rotated by an electrically energized coil which creates a magnetic circuit through two magnetizable poles respectively disposed adjacent to opposite sides of the magnet. The mechanism is housed in a casing which is trapezoidal in axial section so that the display face of the segment is wholly concealed when the display segment is in retracted position. Abutments on a frame are used to stop rotation of the arm in a retracted position, and in a display position. The device dispenses with the usual face plate and mask so that the entire display faces of the segments are exposed when a character is displayed.

10 Claims, 8 Drawing Figures

VARIABLE CHARACTER DISPLAY DEVICE

BACKGROUND OF THE INVENTION

This invention concerns a variable character display device for selectively displaying segments of a character such as a numeral, letter or symbol.

Conventional variable character display devices of which those shown in U.S. Pat. Nos. 3,096,549 issued July 9, 1963, and 3,668,700 issued June 6, 1972, are typical, employ a mask in the form of an opaque face plate formed with seven clear, narrow window openings to expose elongated segments of a character. The mask inevitably occupies a plane in front of the segments and thus a certain amount of parallax results which interferes with the ease of viewing from the side.

SUMMARY OF THE INVENTION

According to the invention a multiplicity of segment display mechanisms are mounted on a flat base plate and surrounded by an open frame without any front face mask. Each segment display mechanism includes a stationary coil on a core which can be externally energized electrically to generate a magnetic field. Two soft iron poles at ends of the coil terminate near a rotatable magnet carried by a small nonmagnetic frame in a small rectangular casing. The iron poles form parts of a magnetic circuit with the magnet and core carrying a coil which is energized with one polarity or the other. The magnet will rotate more than 90° in one direction or the other depending upon the polarity of the magnetic field. The magnet is attached to the arm carrying a display segment. The arm is stopped in rotation in either a display position or a retracted position (of the display segment) by abutments on a wall of the small frame. The magnet is diametrally magnetized so that it is attracted to the two pole pieces equally no matter which way the magnetic axis is swung, to hold the arm and segment in the display position, or the retracted position, when the coil is denergized. Because no front face mask is used, the complete segment display area of a segment is visible, when that segment is in the display position, regardless of the angle from which it is viewed. On the other hand, the combination of the open frame, which has a height substantially the same as the plane of display, of the display segments and rotating the magnets more than 90°, prevent visual observation of those segments in the retracted position.

It is, therefore, a principal object of the present invention to provide a variable character display mechanism which omits the usual face mask so that the entire area of a display segment is visible from all angles when in display position.

It is a further object of the present invention to provide a variable character display device in which display faces of a plurality of display segments are wholly concealed when in a retracted position, by disposition of the segments in planes turned more than 90° to the front plane of the display device.

Another object of the present invention is to provide a variable character display device having more than seven display segments.

BRIEF DESCRIPTION OF THE DRAWINGS

These and other objects and many of the attendant advantages of this invention will be readily appreciated as the same becomes better understood by reference to the following detailed description when considered in connection with the accompanying drawings in which.

DESCRIPTION OF THE PREFERRED EMBODIMENT

Figure 1:
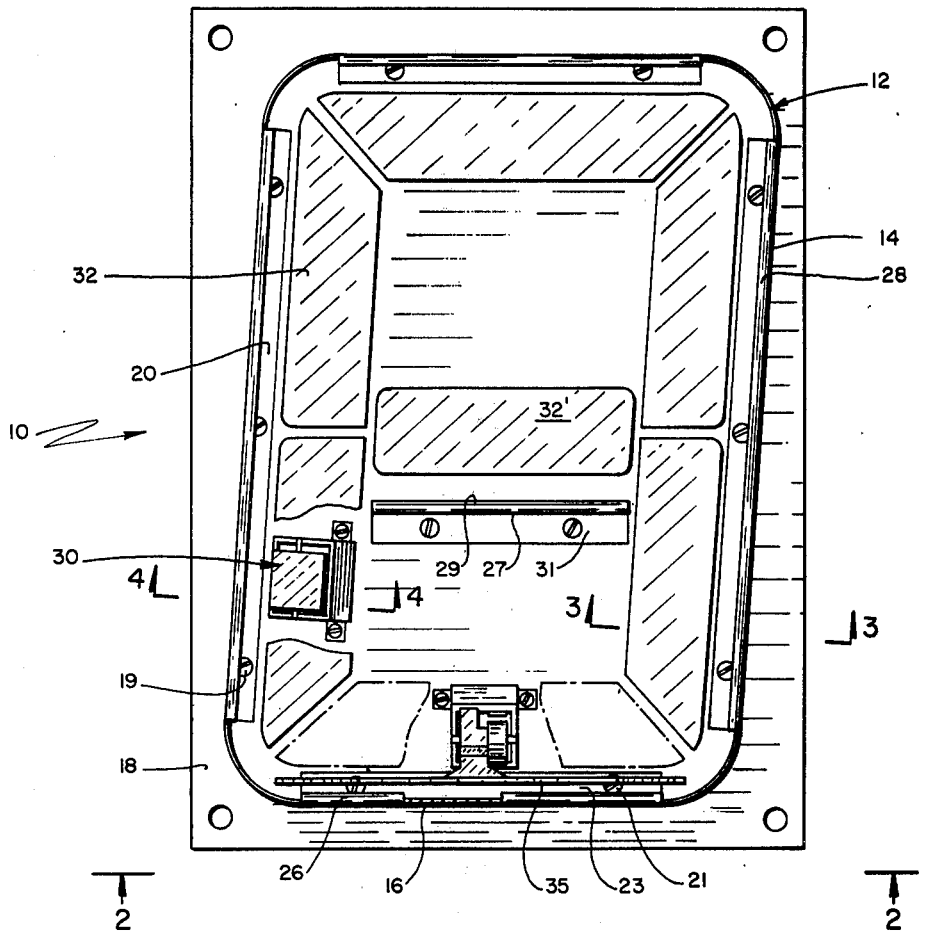
FIG. 1 is a front elevational view of a segmental display device of the digital type embodying the principals of the invention.
Figure 2:
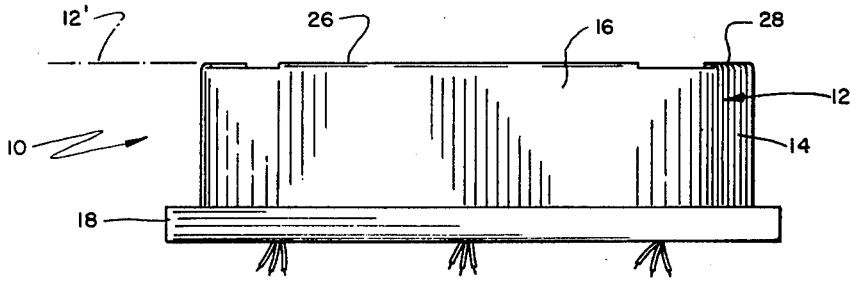
FIG. 2 is a bottom plan view taken along 2—2 of FIG. 1.

Referring now to the drawings wherein like reference characters designate like or corresponding parts throughout, there is illustrated in FIGS. 1–4 a segmental display device generally designated as reference numeral 10 of the digital type comprising a rectangular nonmagnetic metal frame 12 having narrow lateral walls 14 and end walls 16. The frame 12 is secured to a rectangular metal or plastic base plate 18 by a plurality of screws 19 inserted through respective holes inside flanges 20 and in end flanges 23. The end walls 16 and the lateral walls 14 have respective inwardly extending flanges 26 and 28 which act as strengtheners for the respective walls. A transversely disposed wall 27 is disposed adjacent to a transversely disposed display segment 32' and is secured to the base plate 18 via a flange 31 and a pair of screws 21. The wall 27 has an upper flange 29 which acts as a strengthener i.e. as the flanges 26 and 28. The frame 12 is parallelogrammic in form as clearly shown in FIG. 1. Inside the frame 12, on the base plate 18, are seven display mechanisms 30, located substantially below a display plane 12; and each carrying an elongated flag or segment 32 arranged in a conventional rectangular figure "8" array. The construction of the segment display mechanisms 30, which are all identical, is shown best in FIGS. 3–5 to which reference is now made.

Each segment display mechanism 30 includes a rectangular tubular casing 34 made of nonmagnetic metal. The casing 34 has two trapezoidal side walls 36, 38 of equal size, and two opposing rectangular walls 40, 42. The wall 42 is equal in width but longer than the wall 40. The lateral edges of the wall 42 are integral with the longer lateral edges of the side walls 36, 38 while the lateral edges of the shorter wall 40 are integral with the shorter lateral edges of the side walls 36, 38. The side walls 36, 38 have apertured rectangular tabs 39 at their bottom edges for receiving screws 44 which mount the casing 34 on the base plate 18.

A rectangular, plastic frame 46 is snugly fitted in the open top of the casing 34 and is supported by a pair of indentations 48 extending inwardly of the side walls 36, 38. The frame 46 is formed with a pair of spaced, slotted, upstanding ears 50 which engage ends of a pin shaft 52. A cylindrical magnet 54 and a rotatable plastic arm 56 are provided with respective aligned holes 58, 60 through which the pin shaft 52 extends. The arm 56 is rectangular in cross section at its center and is secured by cement or otherwise to an adjacent end face 61 of the magnet 54. The arm 56 and the magnet 54 rotate together.

Figure 8:
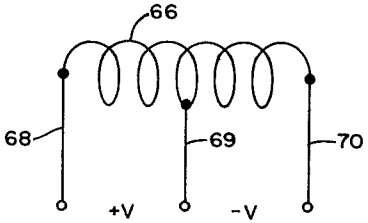
FIG. 8 is a schematic diagram of an activating coil for a segmental display mechanism.

The arm 56 has an integrally formed flat neck section 62 and terminates in an integral flat platform 64. The elongated display segment or flag 32 is secured to the exposed free side of the platform 64. The upper face 33 of the flag 32 is white while the edges and underside are black. Below the rotatable magnet 54 and the arm 56 is a bobbin 65 on which is a coil 66 having many wire turns. As shown schematically in FIG. 8, the coil 66 is centertapped and has three leads 68, 69, 70. The bobbin 65 has a central bore 63 through which extends a screw 72, to hold the coil 66 stationary.

The screw 72 extends through a flanged end 74 of two soft iron magnetic poles 76, 77. The poles 76, 77 extend lengthwise of the casing 34 and their respective free end portions 78 are disposed adjacent opposite diametral sides of the magnet 54. A nut 80 on the screw 72 holds the assembly of the bobbin 65, the coil 66, and the magnetic poles 76, 77, together in the casing 34. The free end of the screw 72 extends through a slot (not shown) in the wall 40 and is engaged by a nut 84 to hold the assembly of the coil 66, the bobbin 65, and the magnetic poles 76, 77, in place, inside the casing 34.

When a voltage of positive polarity is applied to the leads 68, 69, from an external computer readout circuit, the coil 66 generates a magnetic field, and the poles 76, 77, become magnetized with a particular N. S. polarity.

Figure 3:
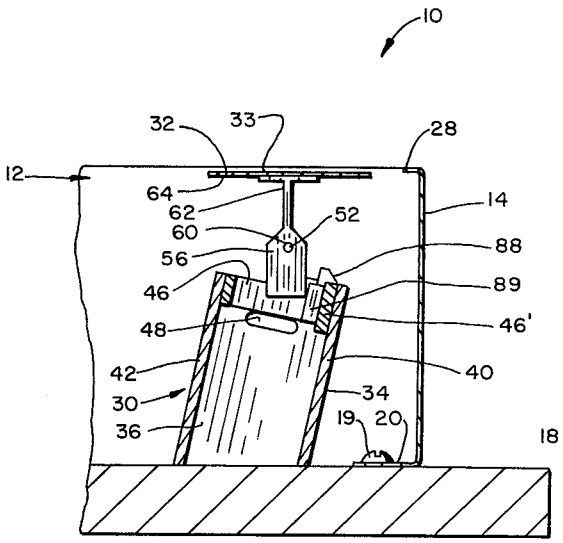
FIGS. 3 and 4 are fragmentary cross sectional views taken along lines 3—3 and 4—4 of FIG. 1.
Figure 4:
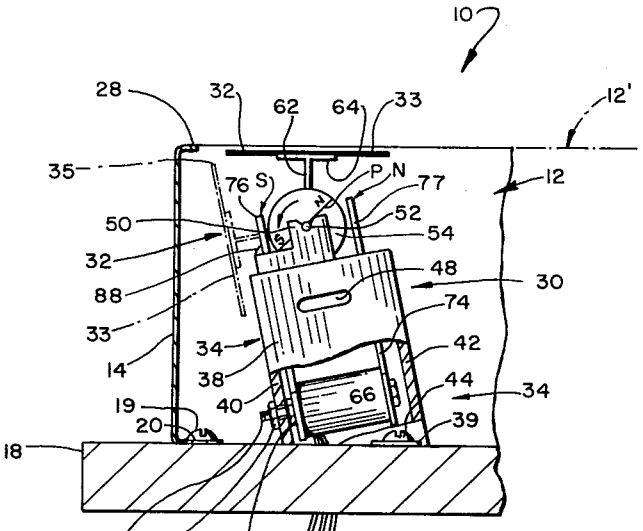

The magnet 54 and the arm 56 then rotate angularly in one direction, counterclockwise for example, as viewed in FIG. 4. This lowers or retracts the display segment 32 to the dotted line position shown in FIG. 4. Angular rotation of the magnet 54, the arm 56, and the display segment 32, is stopped by contact of the flat neck section 62 of the arm 56 with an upwardly extending abutment 88 integrally formed with the upper free edge of the frame wall 46. When a voltage of negative polarity is applied to the leads 69, 70, the coil 66 generates a magnetic field of opposite N. S. polarity and the assembly of the magnet 54, the arm 56 and the display segment 32 rotate clockwise to the display position 12' of segment 32 shown in solid lines in FIGS. 3 and 4. Clockwise rotation of the segment 32 is stopped by contact of the inner end of the arm 56 with an abutment 89 integrally formed with the frame wall 46'.

The free faces 33 of the segments 32 are preferably painted or colored white, while the remainder of the segment display mechanism frame 12 and base plate 18 are painted or colored black. Thus when any display segment 32 is retracted, no part of its white display surface 33 will be visible. The display casing 34 is axially inclined as clearly shown in FIGS. 3 and 4, toward the adjacent wall of the frame 12. Thus the plane of the face 33 of the retracted segment 32 will be inclined laterally downward. This insures that the white face 33 of the retracted segment 32 will be concealed from view at the front or face of the display assembly 10. The full length and width of each segment 32 in the display position is visible at any angle at the front of the display assembly as shown in FIG. 1, since the frame 12 has no front mask plate. The segments 32 are coplanar when displayed and lie in a plane substantially the same as the plane 12' of the front edge of the frame 12, see FIG. 2. When the segments 32 are retracted, their upper edges 35 are concealed below the flanges 26, 28 or 29, respectively, as indicated in FIG. 3. This arrangement insures that no white display face portions 33 of the segments 32 are visible at the open front of the frame 12.

Figure 5:
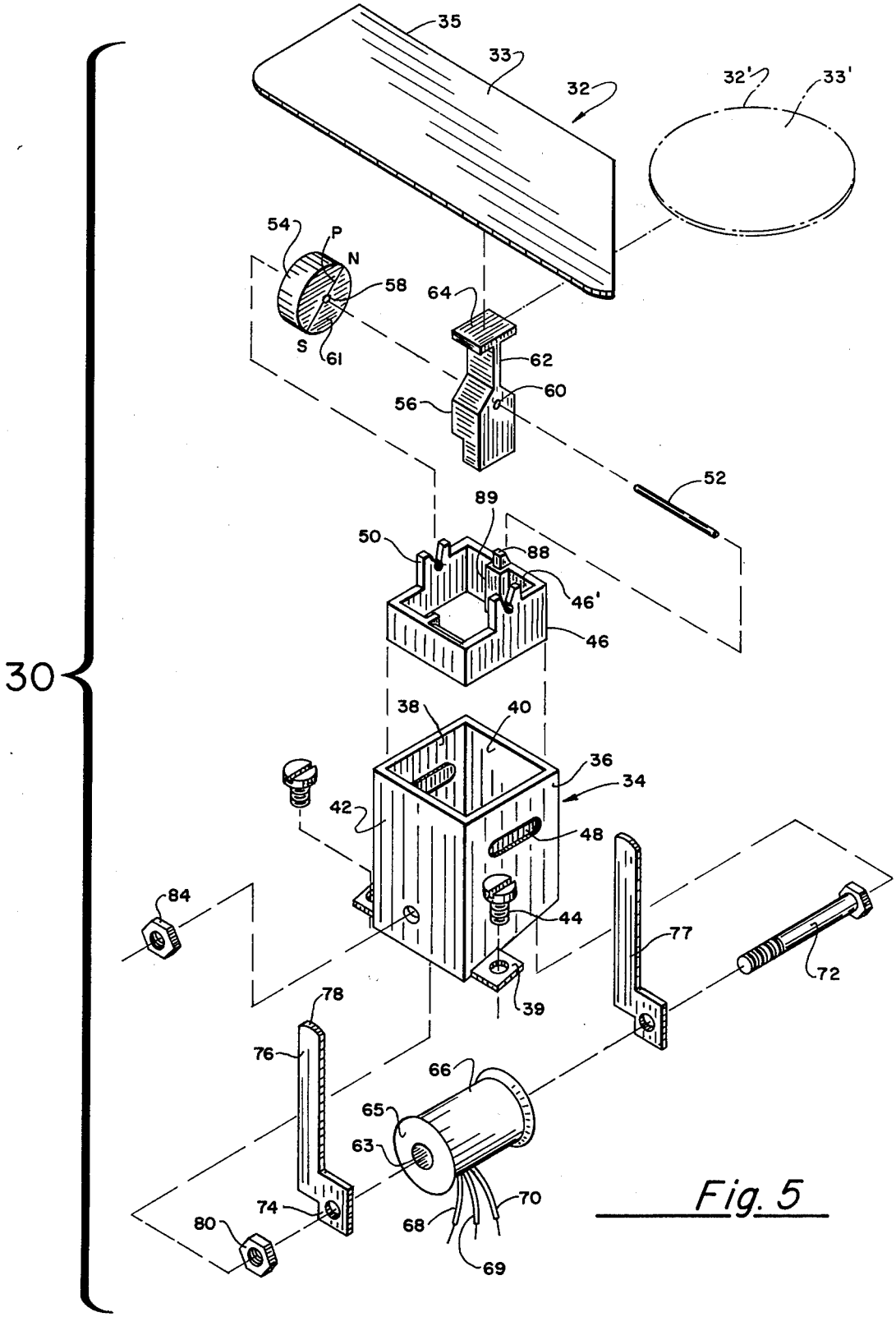
FIG. 5 is an enlarged exploded perspective view showing parts of a segmental display mechanism.

The magnet 54 is magnetized in a diametral plane P indicated in FIGS. 4 and 5. Once the coil 66 in the display mechanism 30 is energized to display the segment 32, the segment 32 will remain displayed event though the coil 66 is thereafter deenergized. This is due to the magnetic attraction of the magnet 54, to the adjacent magnetic pole 77. The magnet 54 remains in an angularly rotated position where the N polar end of plane P is turned toward the pole 77 as far as possible. When the coil 66 becomes energized, the pole 77 becomes the N pole of the magnetic field set up by the coil 66 while the pole 76 becomes the S pole so that the magnet 54 is caused to rotate angularly to the counterclockwise retracted position shown in dotted lines in FIG. 3. If the coil 66 is deenergized after retracting a display segment 32, the segment 32 will remain in retracted position due to magnetic attraction of the magnet 54 to the magnetic pole 76.

By the arrangement described, the full length and width of the white face 33 of each of the display segment 32 is visible when in the display position and the white display face 33 is wholly concealed when the segment 32 is retracted. These desirable conditions are obtained, without use of a slotted, front mask. Display segment 32 will remain locked magnetically in display or retracted position until the coil 66 is energized to rotate the display segment oppositely.

Figure 6:
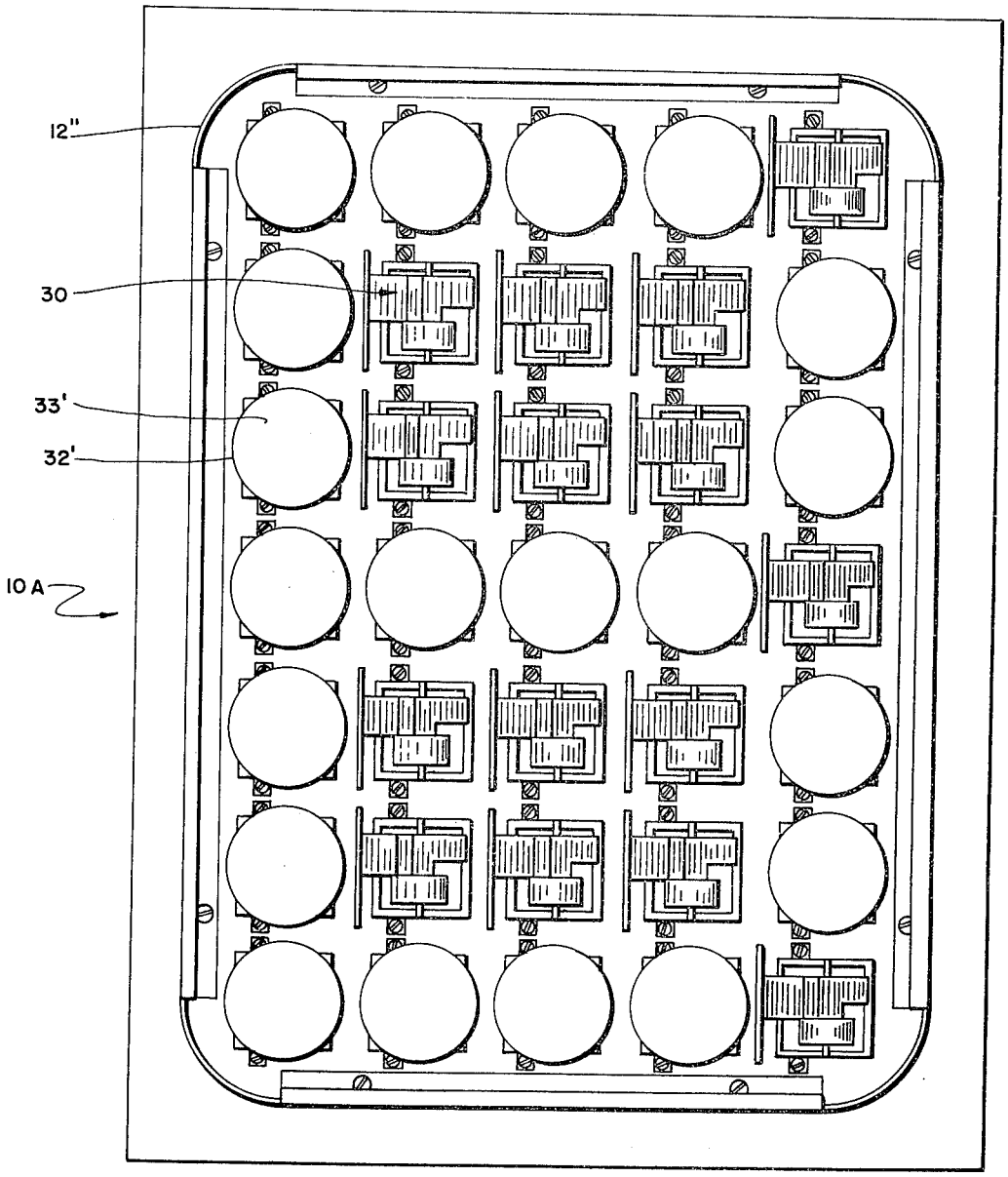
FIG. 6 is a front elevational view of an alphanumeric segmental display device embodying the principals of the invention.
Figure 7:
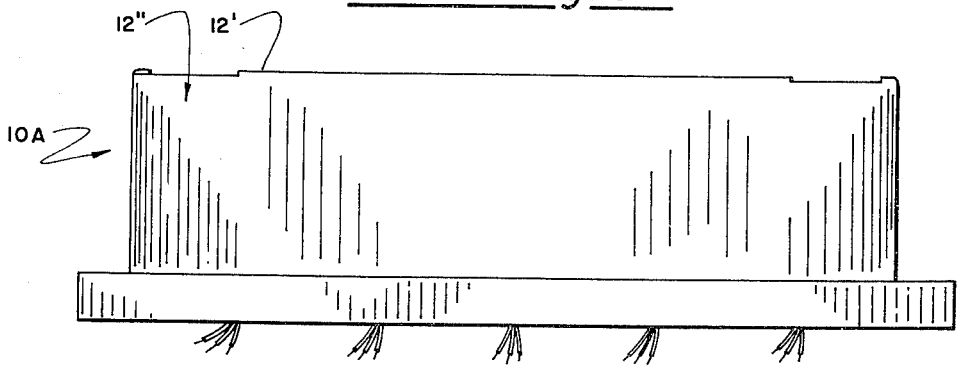
FIG. 7 is a bottom plan view taken along line 7—7 of FIG. 6.

FIGS. 6 and 7 show an alphanumeric display device 10A which has thirty-five segment display mechanisms 30. Each display mechanism carries a circular white display flag or segment 32' with white face 33'. Each of the segments 32' can be a thin plate or disk which is secured to the platform 64 of the display mechanism 30. As indicated by dotted lines in FIG. 5, the circular plate 32' may be substituted for the elongated plate 32. The segment 32' will retract to inclined positions as indicated in FIG. 3, so that their respective white faces 33' will not be visible. When the display segments 32' are in display position, they will be coplanar and below the free face or edge 12' of the frame 12''. The segments 32' will display a single numeral or letter. Thus, as viewed in FIG. 6, the display mechanisms 30 are energized to display the letter "B". The segments 32 can be actuated to display any numeral and any letter of the alphabet, or if desired, any desired symbol or character.

Other parts of display device 10A are similar to those of display device 10 are identically numbered.

It should be understood that the foregoing relates to only a limited number of preferred embodiments of the invention which have been by way of example only and that it is intended to cover all changes and modifications of the examples of the invention herein chosen for the purposes of the disclosure, which do not constitute departures from the spirit and scope of the invention.

The invention claimed is:

1. A variable character display device, comprising;

a base plate;

a multiplicity of variable segment display mechanisms mounted on said base plate in a predetermined array, each of said mechanisms comprising:

a substantially flat display segment having a display face for displaying a portion of a character;

an arm connected perpendicularly to said display segment and extending therefrom;

a rotating means connected to said arm remote from said display segment for rotating said segment between a display position wherein said display face is wholly exposed in a display plane parallel to said base plate and a retracted position wherein said display face is turned more than 90° away from said display plane toward said base plate wherein said rotating means lie in a plane substantially below said display plane; and magnetic means for holding said segment magnetically in either one of said two positions, whereby a selected character is defined by a selected plurality of said segments when rotated to said display position, and whereby all other segments are held magnetically in said retracted position wholly concealing their respective display faces.

2. A variable character display device as defined in claim 1, further comprising an open frame secured to said base plate and surrounding said display mechanisms, said frame extending upwardly to a plane substantially the same as said display plane.

3. A variable character display device as defined in claim 1, wherein each display segment is a thin circular disk.

4. A variable character display device as defined in claim 1, wherein said segment display mechanisms number more than seven to display numerals, letters and symbols.

5. A variable character display device as defined in claim 1, wherein each segment display mechanism comprises:

a rectangular tubular casing secured at one end to said base plate and having a rectangular open top, said casing having opposed trapezoidal walls so that the open top of said casing is angularly inclined to said base plate;

a nonmagnetic frame in the open top of the casing; and wherein said arm is rotatably supported by said frame, whereby said arm abuts said frame when said segment is in said retracted position for wholly concealing said display face of said segment.

6. A variable character display device as defined in claim 5, wherein said means for rotating said segment in said mechanism and for holding said segment in said two positions comprises:

a magnet secured to said arm remote from said display segment;

an electrically energizable coil in said casing secured in a fixed position therein; and two magnetizable poles at ends of said coil having free ends disposed adjacent diametrally opposite sides of said magnet to define a magnet circuit therewith, said magnet being diametrally magnetized, so that said magnet rotates in opposite directions depending on the voltage polarity at ends of said coil.

7. A variable character display device as defined in claim 6, wherein said frame is formed with abutments against which portions of said arm abut in each of said two positions of said display segment, when said magnet is attracted to either one of said two poles.

8. A variable character display device as defined in claim 7, further comprising an open other frame secured to said base plate and surrounding all of said display mechanisms, said frame concealing those of said segments held in retracted position.

9. A variable character display device as defined in claim 7, wherein each display segment is a thin circular disk.

10. A variable character display device as defined in claim 9, wherein said segment display mechanisms number more than seven to display numerals, letters, and symbols.

* * * * *